US005711263A

United States Patent [19]

Brown

[11] Patent Number: 5,711,263

[45] Date of Patent: Jan. 27, 1998

[54] FUEL PRIMER PRESSURE ACCUMULATOR

[75] Inventor: Peter W. Brown, Lake Villa, Ill.

[73] Assignee: Outboard Marine Corporation, Waukegan, Ill.

[21] Appl. No.: 635,839

[22] Filed: Apr. 22, 1996

[51] Int. Cl.[6] ..... F02M 1/16; F02M 69/34

[52] U.S. Cl. ..... 123/179.9

[58] Field of Search ..... 123/179.9, 179.11, 123/179.12, 179.13

[56] References Cited

U.S. PATENT DOCUMENTS

| | | | |
|---|---|---|---|
| 3,620,202 | 11/1971 | Ross | 123/179.13 |
| 4,532,895 | 8/1985 | Kueny | 123/179.9 |
| 4,862,847 | 9/1989 | Kobayashi et al. | 123/179.9 |

*Primary Examiner*—Andrew M. Dolinar
*Attorney, Agent, or Firm*—Jones, Day, Reavis & Pogue

[57] ABSTRACT

A fuel primer pressure accumulator for an internal combustion engine fuel supply system capable of storing fuel under pressure when the internal combustion engine is stopped. The accumulator has a chamber formed by a casing and a pressure element. The accumulator is connected at a fuel inlet passage to the fuel supply line between the fuel pump and the carburetor. The accumulator is connected at a fuel outlet passage to a primer valve and through the primer valve to at least one fuel primer. A check valve is contained in the fuel inlet passage. The check valve permits the passage of fuel into the chamber when the internal combustion engine is running and restricts the passage of fuel out of the chamber when the internal combustion engine is stopped, thereby trapping fuel in the chamber.

15 Claims, 1 Drawing Sheet

FUEL PRIMER PRESSURE ACCUMULATOR

BACKGROUND OF THE INVENTION

The present invention is directed to a fuel primer pressure accumulator for use in internal combustion engines and specifically for use with outboard motors. Modern outboard motors often rely on primer systems for enrichment during cold starting operation. These primer systems generally depend on fuel pressure developed by the engine fuel pump to inject fuel by way of a solenoid valve and injection nozzles into the engine crankcase. With a fully primed engine (an engine in which all fuel lines and carburetor float bowls are completely full) this system works effectively.

However, in engines which have not been used for a period of time, or which have been subjected to high under hood temperatures during a prolonged shutdown period, it is not unusual for fuel in the engine fuel lines to develop considerable amounts of vapor or for the fuel to leak back into the fuel tank, thereby creating air spaces within the fuel lines.

Similarly, during a prolonged shutdown or storage it is not unusual for fuel to evaporate from the carburetor float bowls, thereby leaving the carburetor float valves open. The disadvantage of this type of situation during starting is that when cranking is initiated, the engine fuel pump must first fill all fuel lines with liquid fuel. Then the fuel pump must fill the carburetor float bowls until the float valves shut off. Only then is significant pressure developed in the fuel lines which can cause fuel to be injected through the primer system. Therefore, it is not uncommon after periods of storage for an engine to require considerable cranking before fuel is available at the primer system.

One prior art solution to this problem is to provide an electrically operated primer pump mounted near the fuel tank which can be manually activated by the operator prior to cranking the engine. This allows the fuel system to be completely filled and purged of any air or vapor.

Another prior art solution is to require the operator to pump a manual primer bulb generally located near the transom of the boat to completely fill the fuel system prior to engine starting.

The object of the present invention is to provide an automatic means of priming the engine that does not require the operator to perform any form of manual priming operation, such as that described above.

SUMMARY OF THE INVENTION

According to the invention, a fuel primer pressure accumulator ("accumulator") is provided that can automatically prime an internal combustion engine without requiring the operator to perform any type of manual priming operation The accumulator of the present invention has the ability to store liquid fuel under pressure for long periods of time, so that it may be available to the primer during engine start up. The accumulator comprises a chamber formed by a casing and a pressure element. In the preferred embodiment, the chamber formed by the casing and the pressure element is connected to a fuel supply line, by a fuel inlet passage, between the fuel pump and a fuel supply device. The fuel supply device can comprise a carburetor or a fuel injection nozzle. A check valve is contained in the fuel inlet passage, which permits liquid fuel under pressure to pass from the fuel supply line into the accumulator when the engine is running. When the engine is stopped the check valve closes and prevents fuel from returning from the accumulator back into the fuel supply line. In the preferred embodiment the accumulator is connected to a primer valve by a fuel outlet passage and through the primer valve to the individual primer injection nozzles of the engine.

After the engine is started for the first time the fuel pump charges the accumulator with liquid fuel under pressure. When the engine is stopped the check valve closes and traps fuel under pressure in the accumulator. The liquid fuel is kept under pressure by the pressure element which is biased against the liquid fuel by a biasing element. Upon the next restart, and without the use of an electric primer pump or a manual primer bulb, the primer valve receives pressurized fuel from the accumulator and directs it immediately to the primer injection nozzles. This permits quick starting of the engine without dependence upon manual priming operations.

As pointed out in greater detail below, the fuel primer pressure accumulator of this invention provides the important advantages of an automatic priming means for an internal combustion engine.

The invention itself, together with further objects and attendant advantages, will best be understood by reference to the following detailed description taken in conjunction with the accompanying drawings.

DESCRIPTION OF THE PREFERRED EMBODIMENTS

Figure 1:
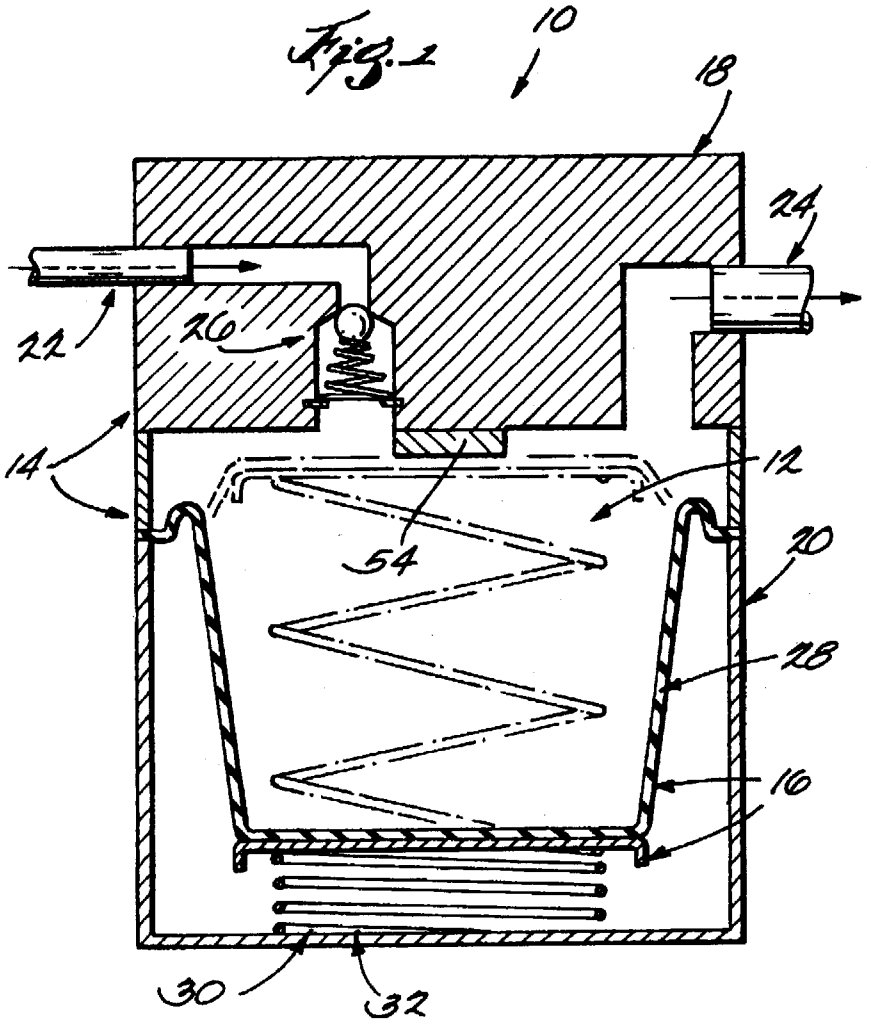
FIG. 1 shows a first embodiment of the fuel primer pressure accumulator of the present invention.

Turning now to the drawings, FIG. 1 shows a first embodiment of the fuel primer pressure accumulator ("accumulator") 10 of the present invention. The accumulator 10 comprises a chamber 12 formed by a casing 14 and a pressure element 16. The casing 14 in the preferred embodiment is constructed from a top block element 18 and a bottom container element 20. The top block element 18 contains a fuel inlet passage 22 and a fuel outlet passage 24. A check valve 26 is contained in the fuel inlet passage 22. The check valve 26 permits liquid fuel under pressure to pass from a fuel supply line (not shown) into the accumulator 10 when the engine (not shown) is running. When the engine is stopped the check valve 26 closes and prevents fuel from returning from the accumulator 10 back into the fuel supply line.

The pressure element 16 of the first embodiment comprises a flexible diaphragm 28, coupled in a sealed manner to the bottom container element 20, and a biasing element 30 (preferably a spring 32) which in turn is coupled to the flexible diaphragm 28. Pressurized fuel presses against the pressure element 16 forcing it downward until an equilibrium is reached between the force exerted by the pressurized fuel and the force exerted by the pressure element 16. When the engine is stopped and the check valve 26 has closed to trap the pressurized fuel in the chamber 12, the force exerted by the pressure element 16 maintains the pressure level of the pressurized fuel.

Figure 2:
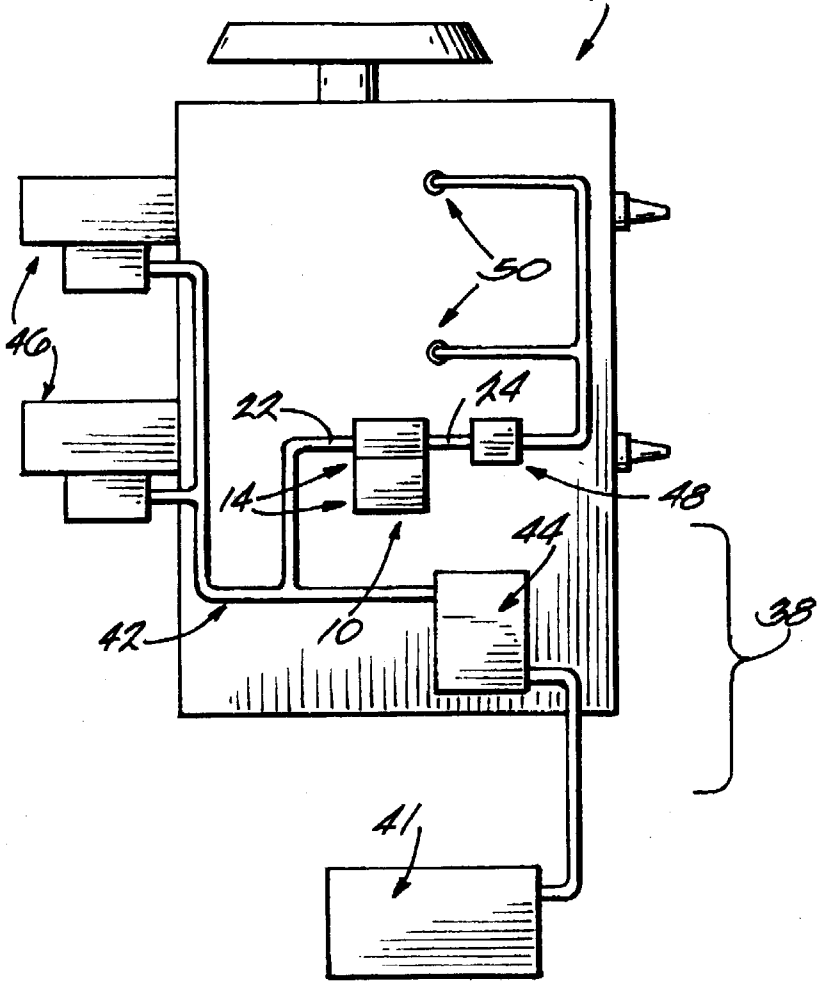
FIG. 2 shows the fuel primer pressure accumulator of the present invention mounted to an outboard motor in a preferred embodiment.

Merely by way of example, FIG. 2 shows a preferred embodiment of a fuel supply system 38 of the invention. The fuel supply system embodiment shown is that of an outboard motor 40. However, the accumulator 10 may be used with any internal combustion engine requiring a priming operation.

As illustrated in FIG. 2 the accumulator 10 is mounted as a side branch of the fuel supply system 38. A fuel tank 41 is shown connected to a fuel pump 44. The fuel inlet passage 22 is connected to a fuel supply line 42 between the fuel pump 44 and at least fuel supply device 46. The fuel supply device 46 may comprise a carburetor or a fuel injection nozzle. The accumulator 10 is connected to a primer valve 48 through the fuel outlet passage 24 and through the primer valve 48 to at least one fuel primer 50 of the outboard motor 40. A suitable primer valve 48 of the preferred embodiment is a primer solenoid control valve. In common outboard motors the fuel primers comprise primer ports in the engine with fuel primer injection nozzles disposed in the primer ports (not shown).

In construction and mounting of the fuel accumulator 10, care must be taken to minimize the opportunity for air and fuel vapor to enter the accumulator 10. In the preferred embodiment, the accumulator 10 is mounted below the fuel supply line 42 to which it is attached. Since fuel vapor or air will have a natural tendency to flow upward in fuel passages the mounting of the accumulator 10 beneath the fuel supply line 42 will tend to avoid having this air or fuel vapor enter the accumulator 10.

After the engine is started for the first time, the fuel pump charges the accumulator with liquid fuel under pressure. When the engine is stopped, the check valve closes and traps fuel under pressure in the accumulator. The liquid fuel is kept under pressure by the pressure element which is biased against the liquid fuel by a biasing element 30. Upon the next restart, and without the use of an electric primer pump or a manual primer bulb, the primer valve receives pressurized fuel from the accumulator and directs it immediately to the primer injection nozzles. This permits quick starting of the engine without dependence upon manual priming operations.

Variations on the embodiments are possible. For example the accumulator and the primer valve can be built and housed in a single assembly unit.

In another variation as illustrated in FIG. 1, the top block element 18 can further include a stopper 54 for restricting the range of motion of the flexible diaphragm 28.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A fuel primer pressure accumulator for an internal combustion engine comprising:

a chamber;

a fuel inlet passage connected to the chamber;

a fuel outlet passage connected to the chamber;

a primer control valve connected to the fuel outlet passage; and a check valve coupled to the fuel inlet passage permitting the passage of pressurized fuel into the chamber when the internal combustion engine is running and restricting the passage of fuel out of the chamber when the internal combustion engine is stopped, thereby trapping fuel under pressure in the chamber.

2. The fuel primer pressure accumulator according to claim 1, wherein the chamber is formed by a casing and a pressure element.

3. The fuel primer pressure accumulator according to claim 2, wherein the pressure element comprises a diaphragm coupled to a biasing element.

4. The fuel primer pressure accumulator according to claim 1 wherein said primer control valve is a solenoid controlled valve.

5. A fuel primer pressure accumulator for an internal combustion engine, capable of storing fuel under pressure when the internal combustion engine is stopped, comprising:

a chamber formed by a casing and a pressure element;

a fuel inlet passage connected to the chambers;

a fuel outlet passage connected to the chamber;

a primer control valve connected to the fuel outlet passage; and a check valve coupled to the fuel inlet passage, permitting the passage of fuel into the chamber when the internal combustion engine is running and restricting the passage of fuel out of the chamber when the internal combustion engine is stopped, thereby trapping fuel in the chamber.

6. The fuel primer pressure accumulator according to claim 5, wherein the pressure element comprises a diaphragm coupled to a biasing element.

7. The fuel primer pressure accumulator according to claim 5 wherein said primer control valve is a solenoid controlled valve.

8. A fuel supply system for an internal combustion engine comprising:

a fuel pump;

a fuel supply line connected to the fuel pump and at least one fuel supply device; and a fuel primer pressure accumulator connected at a fuel inlet passage to the fuel supply line between the fuel pump and the at least one fuel supply device and connected at a fuel outlet passage to a primer valve and through the primer valve to at least one fuel primer, a check valve in the fuel inlet passage permitting the passage of fuel into the accumulator when the engine is running and restricting the passage of fuel out of the accumulator when the engine is stopped, wherein the fuel primer pressure accumulator is capable of storing fuel under pressure when the internal combustion engine is stopped.

9. The fuel supply system of claim 8 wherein: the fuel primer pressure accumulator comprises:

a chamber;

a fuel inlet passage connected to the chamber;

a fuel outlet passage connected to the chamber; and said check valve coupled to the fuel inlet passage permitting the passage of fuel into the chamber when the internal combustion engine is running and restricting the passage of fuel out of the chamber when the internal combustion engine is stopped, thereby trapping fuel in the chamber.

10. The fuel supply system according to claims 8, wherein the fuel primer pressure accumulator is mounted below the fuel supply line to which it is connected.

11. The fuel supply system according to claims 9, wherein the fuel primer pressure accumulator is mounted below the fuel supply line to which it is connected.

12. The fuel supply system according to claim 9, wherein the chamber is formed by a casing and a pressure element.

13. The fuel supply system according to claim 9, wherein the pressure element comprises a diaphragm coupled to a biasing element.

14. The fuel supply system according to claim 8 wherein the fuel supply device is a carburetor.

15. The fuel supply system according to claim 8 wherein the fuel supply device is a fuel injection nozzle.

* * * * *